US008667895B2

(12) United States Patent
Gerigk et al.

(10) Patent No.: US 8,667,895 B2
(45) Date of Patent: Mar. 11, 2014

(54) DEVICE FOR APPLYING ONE MULTIPLE-PASS PRINT EACH TO PACKAGING CONTAINERS

(75) Inventors: Katrin Gerigk, Gelsenkirchen (DE); Manfred Pschichholz, Kamen (DE); Frank Putzer, Hamburg (DE); Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 391 days.

(21) Appl. No.: 13/061,988

(22) PCT Filed: Aug. 4, 2009

(86) PCT No.: PCT/EP2009/005615

§ 371 (c)(1), (2), (4) Date: Mar. 3, 2011

(87) PCT Pub. No.: WO2010/034375

PCT Pub. Date: Apr. 1, 2010

(65) Prior Publication Data

US 2011/0179959 A1 Jul. 28, 2011

(30) Foreign Application Priority Data

Sep. 26, 2008 (DE) ..... 10 2008 049 241

(51) Int. Cl.
*B41F 17/18* (2006.01)

(52) U.S. Cl.
USPC ..... 101/35; 101/40.1; 101/479; 101/480

(58) Field of Classification Search
USPC ..... 101/35, 36, 37, 38.1, 39, 40, 40.1, 479, 101/480, 232
See application file for complete search history.

(56) References Cited

U.S. PATENT DOCUMENTS

| | | | | |
|---|---|---|---|---|
| 5,806,420 | A * | 9/1998 | Erhard et al. | 101/37 |
| 6,019,046 | A * | 2/2000 | Rodi | 101/479 |
| 6,298,638 | B1 | 10/2001 | Bettle | |
| 2002/0023559 | A1 * | 2/2002 | Frankenberger et al. | 101/232 |
| 2005/0120901 | A1 * | 6/2005 | Albrecht et al. | 101/480 |
| 2006/0144261 | A1 | 7/2006 | Uptergrove | |
| 2006/0250464 | A1 | 11/2006 | Sheinman | |
| 2011/0067584 | A1 * | 3/2011 | Mueller et al. | 101/35 |
| 2012/0199021 | A1 * | 8/2012 | Till | 101/36 |
| 2012/0255450 | A1 * | 10/2012 | Till | 101/38.1 |

FOREIGN PATENT DOCUMENTS

| | | |
|---|---|---|
| DE | 4237577 | 5/1993 |
| DE | 10322556 | 4/2004 |
| EP | 0813971 | 12/1997 |
| EP | 1625942 | 2/2006 |
| EP | 2 152 519 | 2/2010 |
| WO | 2004/000936 | 12/2003 |

* cited by examiner

*Primary Examiner* — Leslie J Evanisko

(74) *Attorney, Agent, or Firm* — Occhiuti & Rohlicek LLP

(57) ABSTRACT

The invention relates to a device for printing one multiple-pass print on each packaging container (2), on which the packaging containers are moved in a transport direction past printing stations or printing heads for applying the multiple-pass print. The device is constructed from a plurality of modules (4.1-4.8) in at least a partial area. Each module comprises at least one transport element having an associated drive. The transport elements of the module adjacent to each other form at least one part of the transport path.

20 Claims, 4 Drawing Sheets

Fig. 4
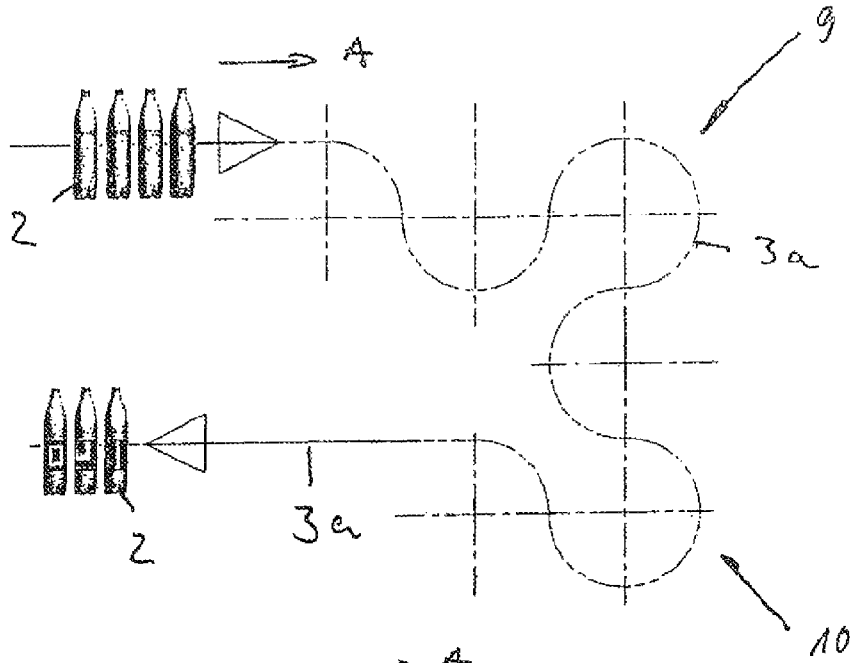
Fig. 6
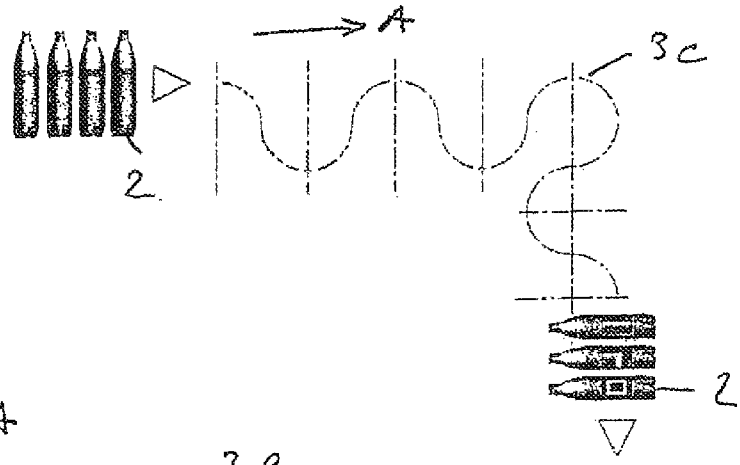
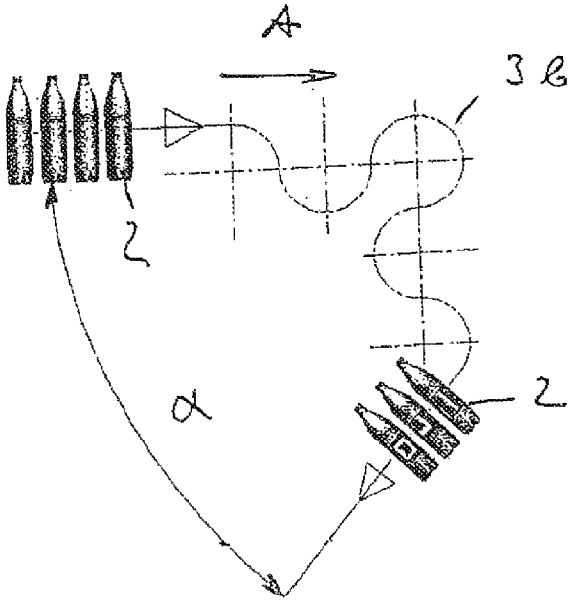
Fig. 5

DEVICE FOR APPLYING ONE MULTIPLE-PASS PRINT EACH TO PACKAGING CONTAINERS

CROSS-REFERENCE TO RELATED APPLICATIONS

This application is the National Stage of International Application No. PCT/EP2009/005615, filed on Aug. 4, 2009, which claims the priority of German Patent Application No. 10 2008 049 241.8, filed on Sep. 26, 2008. The contents of both applications are hereby incorporated by reference in their entirety.

FIELD OF INVENTION

The invention relates to a device for printing on packaging containers.

BACKGROUND

Packaging containers in the sense of the invention are in particular bottles, cans, or similar containers. A multiple-pass print in the sense of the invention is generally a print generated with a plurality of print images or compositions, preferentially a multicolor print from a plurality of color sets of different colors, for example yellow, magenta, cyan and black.

Devices for printing packaging containers, in particular also for applying a color or multicolor print to packaging containers, are known and comprise for example a conveyor section on which the printing of the packaging containers is done, this being effected with the corresponding printing units or printing heads generating the color sets and provided at or on the conveyor section. The printing heads are, for example, printing heads or printing units that can be electrically or electronically triggered, e.g. printing heads operating on the inkjet printing principle (WO2004/00936) or printing heads operating under the designation "tonejet principle".

SUMMARY

The object of the invention is to provide a device that combines great flexibility with a simplified layout.

The particularity of the device according to the invention resides in its modular layout, which endows it with substantial advantages. Thus, for example, the setting up and changing over, the cleaning, the repair etc. of the individual modules can be effected completely separately from the device or system concerned that is in operation by exchanging modules. An optimal utilization and adaptation to spatial conditions is, moreover, possible by appropriate arrangement of the individual modules.

In particular the device or system can be configured according to the prevailing needs and adapted without difficulty to corresponding requirements or changes in requirements, for example, also by removing or adding modules, e.g. for a process extension, i.e. for the introduction of additional process steps into an already existing system, such as, for example, in the case of a color addition, the insertion of additional process steps for drying or intermediate drying of the multiple-pass print concerned, or of the color sets of a multicolor print, for aligning the bottles or containers etc.

The modular device can be adapted to the prevailing circumstances even in the case of a subsequent change to the layout of a system or of a production line. Thus, for example, in confined spaces, a device with a head transport (KT), i.e. a device in which the container intake and container outlet are located on a common side, can be configured from an existing linear device in order to overcome a dead end within a production line.

Further embodiments, advantages, and possible applications of the invention arise out of the following description of embodiments, and out of the figures. All of the described and/or pictorially represented attributes, whether alone or in any desired combination, are fundamentally the subject matter of the invention independently of their synopsis in the claims or a retroactive application thereof. The content of the claims is also made an integral part of the description.

DESCRIPTION OF THE FIGURES

The invention is explained in detail below through the use of embodiment examples with reference to the figures, in which:

FIGS. 4-7 depict further embodiments of the invention in representations similar to FIG. 3.

DETAILED DESCRIPTION

Figure 1:
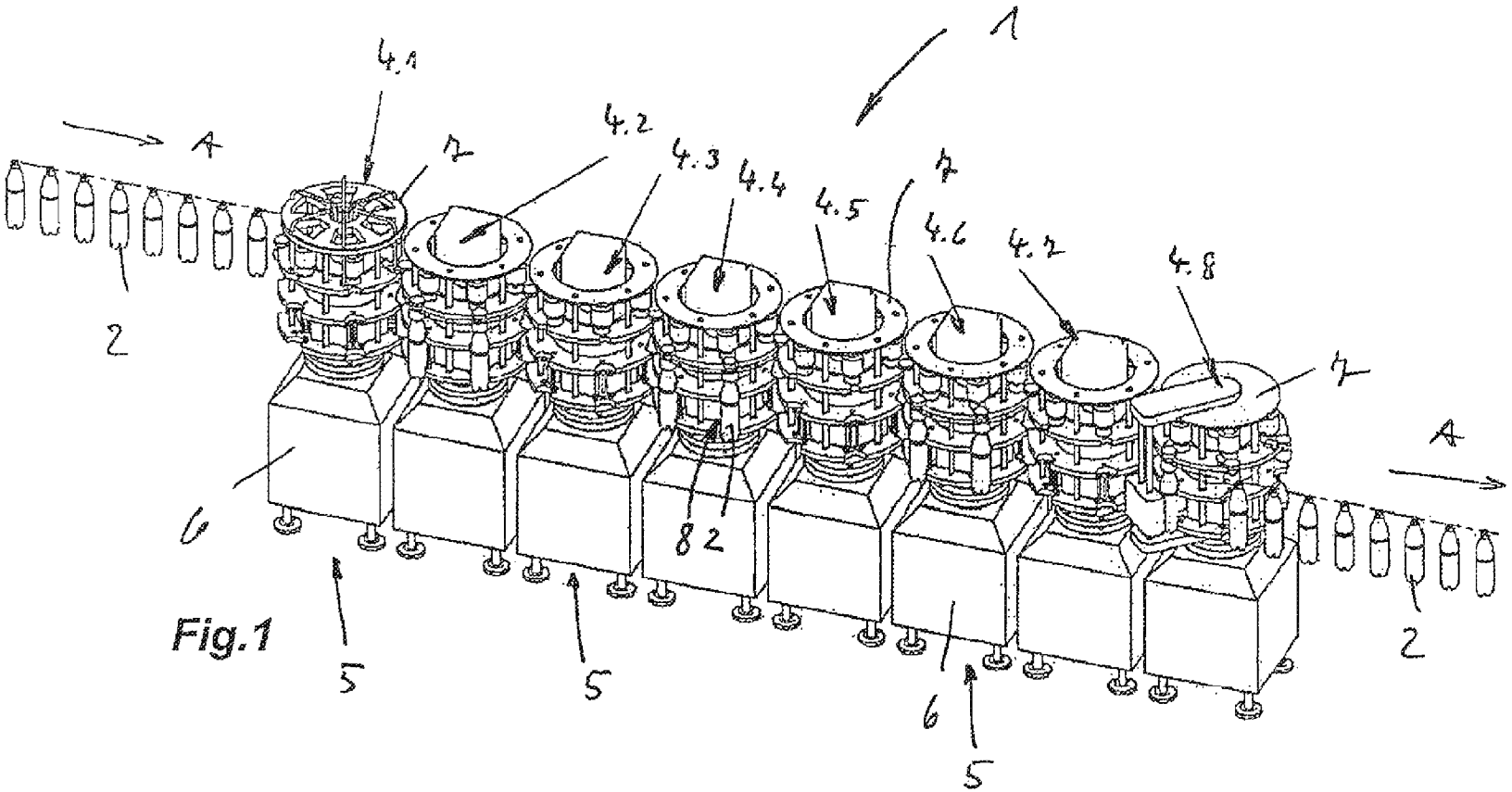
FIG. 1 depicts a simplified schematic and perspective representation of a device or system for applying a multiple-pass print to containers in the form of bottles.
Figures 2, 3:
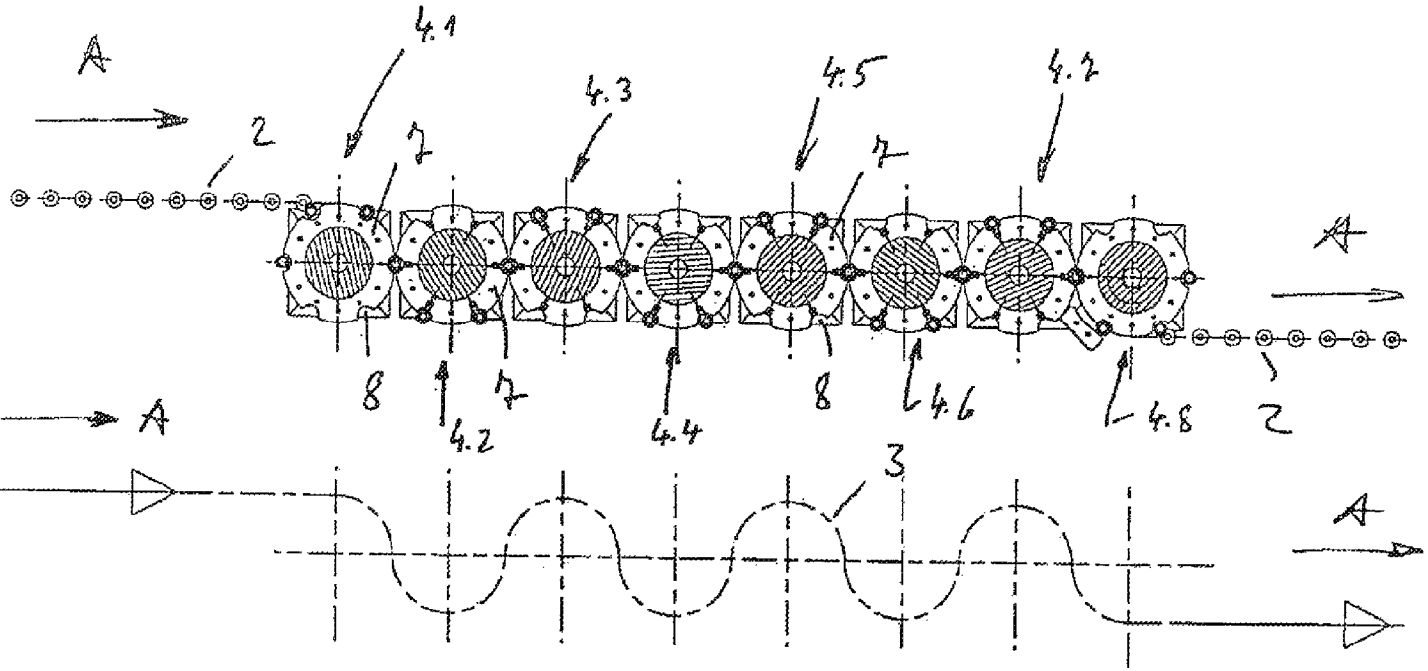
FIG. 2 depicts the device of FIG. 1 in plan view.
FIG. 3 depicts a schematic representation and plan view of the transport or conveyor path of the bottles through the device shown in FIGS. 1 and 2.

The device generally designated by 1 in FIGS. 1 and 2 is used to apply a multiple-pass print to bottles 2, either directly to the exterior or envelope surface of the bottles 2, or to labels, e.g. provided with partial equipping, already affixed thereto.

For printing, the bottles 2 are fed standing upright to the device 1 by means of an external conveyor in a transport direction A, then moved within the device 1 on a multiply arcuatedly deviated conveyor section. After printing, the bottles 2 are fed, still standing upright, by an external conveyor to a subsequent use. The transport path of the bottles 2, when feeding, when moving through the device 1, and when exiting the device 1, is represented schematically in FIG. 3 by the reference numeral 3.

In detail, the device 1 has a plurality of modules 4.1-**4.*n* arranged immediately contiguously in a transport direction A. The depicted embodiment has, in all, eight modules 4.1-4.8, with all modules 4.1-4.8 being formed from an identical base unit 5 that is equipped with the functional elements necessary for the special task of the respective modules 4.1-4.8**.

Each base unit 5 comprises, inter alia, a drive and control unit accommodated in a module housing 6, and a transport element 7 having the form of a conveyor star or process star with a large number of holders 8, the transport element 7 being arranged on the top of the module housing 6 and circumferentially drivable by the drive and control unit, inter alia, about a vertical machine axis of the respective modules 4.1-4.8, the holders 8 being distributed at even angular distances over the periphery of the transport element 7, each holder 8 serving to securely hold one bottle 2.

The transport elements 7 of the individual modules 4.1-4.8 are arranged immediately adjacent to one another and driven in counter-rotation but synchronously such that these transport elements 7, in their totality, form a conveyor by which the bottles 2 are moved within the device 1 on the multiply deviated transport path 3 shown in FIG. 3 with the container intake at one end of the device 1 and the container outlet at the other end of the device 1. The individual bottles 2 are each transferred directly from the transport element 7 of one module 4.1-4.7 to the transport element 7 of a successive module 4.2-4.8 that follows in the transport direction A.

In the representation in FIG. 2, transport element 7 of module 4.1, which is the first relative to the transport direction A, is driven synchronously clockwise, transport element 7 of the next-following module 4.2 is driven counterclockwise, transport element of the next-following module 4.3 is again driven clockwise, and so forth. The synchronization of the individual modules 4.1-4.8 is effected by suitable control means.

In the embodiment shown in FIGS. 1-3, the individual modules 4.1-4.8 are also provided sequentially such that the vertical machine axes of all modules 4.1-4.8 lie in a common vertical plane parallel to which the feeding and discharge of the bottles 2 respectively to and from the device 1 is effected and in which are also located the transfer areas within which the bottles 2 are transferred from the transport element 7 of one module 4.1-4.7 to the transport element 7 of the module 4.2-4.8 that follows in transport direction A.

By way of example the function of the individual modules 4.1-4.8 is as follows:

Module 4.1 forms, inter alia, the intake module and/or the container intake of the device 1. Module 4.1 also preferentially effects a pretreatment of the bottles 2, at least in the bottle area that is to be printed, for example, a plasma or corona treatment, coating, adhesive application, electrostatic charge or the like, that is practicable particularly when the application of the multiple-pass print in the subsequent modules is effected with the use of printing stations or printing heads in those modules and that operate according to the known inkjet printing head principle or the so-called tone-jet principle.

The modules 4.2-4.5 following module 4.1 constitute the actual print modules in which the multiple-pass print is effected, preferentially as a color print in which one color set of the color print is printed at each of the modules 4.2-4.5, for example, in yellow, magenta, cyan and black.

The module 4.6 that then follows in the transport direction A is configured as a drying module in which the previously generated multiple-pass print concerned is dried in a suitable manner, for example, by the application of energy in the form of, say, heat, microwaves, electron radiation and/or UV radiation.

Module 4.7 is configured as an inspection module through which each bottle 2 passes after the drying of the multiple-pass print, and in which the multiple-pass print concerned is examined for possible errors so that incorrectly printed bottles 2 can be separated out at module 4.7 or subsequently on the onward transport path.

Finally, module 4.8 constitutes the outlet module or container outlet of the device 1 at which the fully printed bottles 2 exit the device 1. Module 4.8 is preferentially also configured as a drying module.

As shown particularly in FIGS. 2 and 3, the bottles 2 are each moved by the transport elements 7 of modules 4.1 and 4.8 over an angular range of approximately 90° about the vertical machine axis of modules 4.1 and 4.8. In the case of the other modules 4.2-4.7 the bottles 2 are each entrained by the transport element 7 concerned over an angular range of 180° about the vertical machine axis of the modules 4.2-4.7. Especially in modules 4.2-4.7, the process that is assigned to the respective module is effected within this angular range or within this path of the rotational motion of the transport element 7 concerned.

Figure 7:
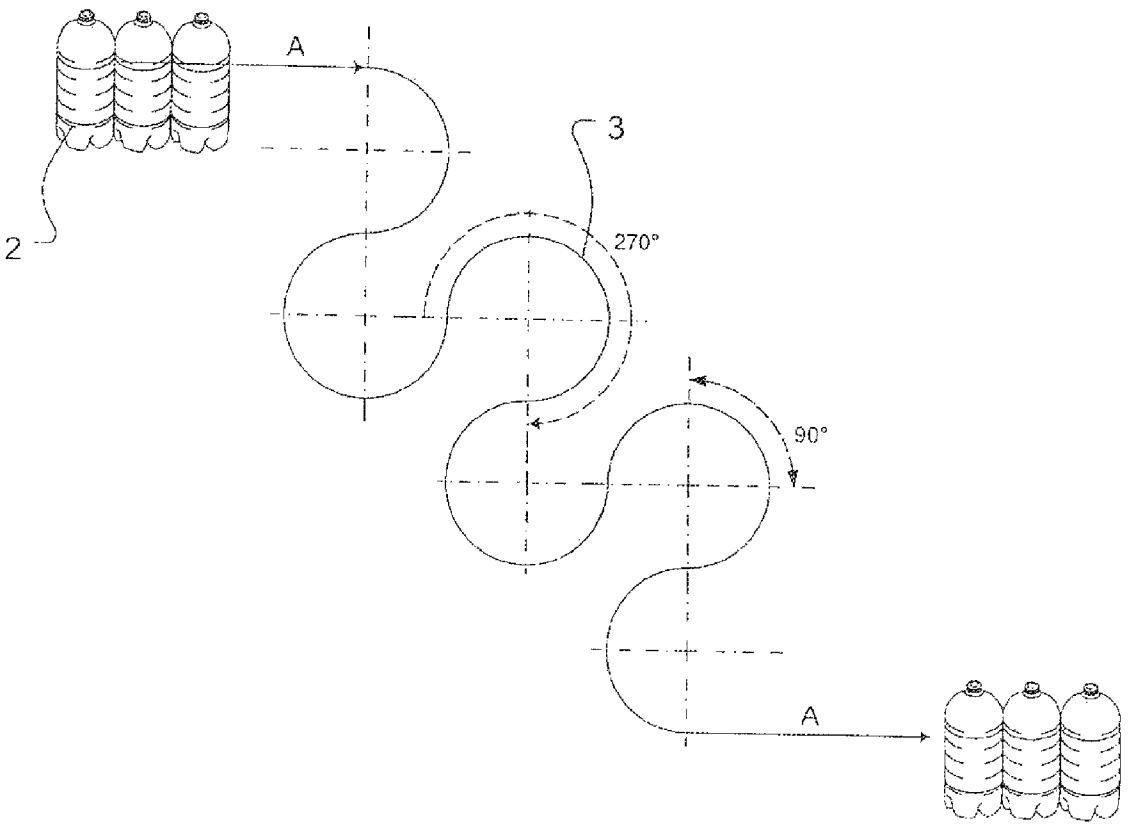

If, for example, the angular range of 180°, or the corresponding path, is insufficient for the process at one or more modules, then this angular range can also be increased by appropriate arrangement of the contiguous modules, for example, to an angular range of 270°, as is suggested in FIG. 4 and FIG. 7 with the transport path 3*a* at identified by reference numerals 9 and 10 shown therein.

In order to achieve a larger angular range, at the modules forming sections 9 and 10 of the transport path 3*a* the transfer areas at which the bottle 2 is transferred to this module from a preceding module and to the subsequent module are offset by an angle greater than 180° about the machine axis, for example, by an angle of 270°, this being effected by the machine axis of the module with the increased angular range being arranged with the machine axis of the preceding module in a first vertical plane and with the machine axis of the subsequent module in a second vertical plane and by both planes including an angle, for example, an angle of 90°, to one another.

The transport path over which the bottles 2 are moved through the device 1 can be configured at will by appropriate arrangement of the modules 4.1-4.*n* according to the particular requirements and/or adapted to the particular spatial conditions, for example, as shown in FIG. 3, such that the container intake and container outlet are located at opposite ends of the device 1, as is the case with the version shown in FIGS. 1-3, or alternatively according to FIG. 4 and/or according to the transport path 3*a* therein shown such that the container intake and container outlet are located on a common side of the device or system, i.e. a head transport (HT) of the bottles 2 is effected through the system, or alternatively according to transport path 3*b* in FIG. 5 such that the container intake and container outlet are offset to one another by an angle a, for example, by an angle a of 50°, or alternatively according to transport path 3*c* in FIG. 6 such that the container intake and container outlet are offset to one another by an angle of 90°. Any desired other variants of the arrangement or setup of the individual modules 4.1-4.*n* is conceivable.

An advantageous embodiment that is not shown includes the modules (4.1-4.*n*) having one or more printing heads and other functional elements arranged thereon. These other functional elements are, in particular, devices for the drying or intermediate drying of the printing ink. One or more devices for surface treatment and/or inspection may, however, also be provided alone or in combination therewith if need be.

The invention has been described hereinbefore by reference to one embodiment. It goes without saying that numerous variations as well as modifications are possible without departing from the inventive concept underlying the invention. The invention has been explained hereinbefore in conjunction with bottles 2. However the device according to the invention can also be used to print on other containers or packaging containers.

REFERENCE LIST

1 Device
2 Bottles or packaging containers
3, 3*a*, 3*c* Transport path
4.1-4.*n* Module
5 Base unit
6 Module housing
7 Transport element or transport or process star
8 Holder
9, 10 Section of the transport path
A Direction of transport

The invention claimed is:

1. An apparatus for printing on packaging containers, said apparatus comprising a transport section over which packaging containers are moved in a transport direction past at least one of printing stations and printing heads, said apparatus further comprising a partial area having multiple modules in a modular layout, at least some of said modules being contiguous modules, each module having at least one transport element with an associated drive, wherein said transport elements of said contiguous modules form at least a part of said transport section for said packaging containers, wherein at least some of said modules are configured as print modules with printing heads or printing stations provided within an area of their respective transport elements, wherein at least some of the transport elements of the contiguous modules are circumferentially drivable about a vertical machine axis, and wherein each transport element comprises holders, each of which is configured to hold a packaging container.

2. The apparatus of claim 1, wherein at least some of the modules comprise transport elements that are immediately contiguous with transfer areas to at least one of accept and convey the packaging containers.

3. The apparatus of claim 1, wherein at least two modules succeeding one another in the transport direction are configured as print modules for printing different colors on a packaging container.

4. The apparatus of claim 3, wherein each of the print modules is configured to imprint a particular color set of the colour color imprint.

5. The apparatus of claim 1, wherein one of the modules comprises a container intake.

6. The apparatus of claim 1, wherein at least one module preceding a module configured as a print module in the transport direction is configured for the pre-treatment of the packaging containers at least on an area that is to be printed on.

7. The apparatus of claim 1, wherein at least one module that follows a print module in the transport direction is configured as a drying module.

8. The apparatus of claim 1, wherein one module forms one of a packaging container outlet and a container outlet.

9. The apparatus of claim 8, wherein the packaging container or container outlet is combined with a drying unit.

10. The apparatus of claim 1, wherein at least one module comprises a module for surface treatment.

11. The apparatus of claim 10, wherein the module for surface treatment comprises a plasma-treatment module.

12. The apparatus of claim 10, wherein the module for surface treatment comprises a module for adhesive application.

13. The apparatus of claim 10, wherein the module for surface treatment comprises a module for application of electrostatic charge.

14. The apparatus of claim 10, wherein the module for surface treatment comprises a module for coating.

15. The apparatus of claim 10, wherein said module for surface treatment comprises a corona-treatment module.

16. The apparatus of claim 1, wherein the transport elements of the contiguous modules are circumferentially drivable synchronously in such a manner that transport elements of adjacent modules rotate in opposite directions.

17. The apparatus of claim 1, wherein the transport elements are arranged such that a transport path of the transport section has at least one angular deflection.

18. The apparatus of claim 1, wherein the modules each comprise identical base units, each of which contains a transport element, an associated drive, and a control unit, and wherein each module comprises, on the base unit thereof, functional elements adapted to the particular function of the module.

19. The apparatus of claim 1, wherein the holders are disposed on a process star.

20. The apparatus of claim 1, wherein at least one module that follows a print module in the transport direction is configured as an inspection module.

* * * * *